United States Patent [19]

Thomas

[11] 4,380,842

[45] Apr. 26, 1983

[54] TOOL SUPPORT APPARATUS

[75] Inventor: John W. Thomas, McDonald, Pa.

[73] Assignee: Shenango Incorporated, Pittsburgh, Pa.

[21] Appl. No.: 286,272

[22] Filed: Jul. 23, 1981

[51] Int. Cl.[3] ..... B08B 1/00

[52] U.S. Cl. ..... 15/304; 15/104.07; 15/312 R; 173/35; 248/654

[58] Field of Search ..... 15/56, 304, 312, 104.07, 15/104.1; 248/647, 654; 173/34, 35, 43

[56] References Cited

U.S. PATENT DOCUMENTS

| | | | |
|---|---|---|---|
| 1,827,085 | 10/1931 | Huff . | |
| 2,789,296 | 4/1957 | Cheadle | 15/304 X |
| 2,931,060 | 4/1960 | Kelly | 15/104.1 |
| 3,175,239 | 3/1965 | Casperson | 15/104.1 |
| 3,471,888 | 10/1969 | Grant et al. | 15/104.07 |
| 3,996,637 | 12/1976 | Shibata et al. | 15/56 |
| 4,095,306 | 6/1978 | Norton | 15/104.07 |
| 4,153,965 | 5/1979 | Merly | 15/104.1 |
| 4,290,239 | 9/1981 | Zimmer | 248/654 X |

*Primary Examiner*—Chris K. Moore

*Attorney, Agent, or Firm*—Webb, Burden, Robinson & Webb

[57] ABSTRACT

Tool support apparatus having a frame mounted on wheels and motors for driving the wheels to move the frame. A ram tube carrying different tools at its lower end supported in a cylinder mounted on an oscillator bracket which cooperates with an oscillator slide carriage slidably mounted on shafts supported on the frame and a hydraulic cylinder mounted on the frame for moving the oscillator slide carriage along the shafts. An electric motor for moving the lower end of the ram tube in a first arcuate direction and another electric motor for moving the lower end of the ram tube in a second arcuate direction in a plane perpendicular to the plane of movement in the first arcuate direction. A hydraulic cylinder attached to the ram tube for moving it vertically.

13 Claims, 10 Drawing Figures

TOOL SUPPORT APPARATUS

BACKGROUND OF THE INVENTION

1. Field of the Invention

The invention relates generally to apparatus for supporting tools for cleaning and coating the inside surface of ingot molds used in steel mills to produce high quality ingots and more particularly to apparatus having mechanism for adjusting the position of the tools in a mold so that the tools can contact the complete inner surface of molds or different sizes and configurations.

Ingots will have poor surface quality if slag is permitted to remain on the inside of a mold since the slag is incorporated into the surface of ingots poured into the mold. Additionally, slag which is solidified on the inside of a mold during teeming causes the surface of the mold to become rough so that subsequent ingots poured into the mold will have a rough surface. In order to avoid these problems, the inside of ingot molds must be frequently cleaned to remove accumulated slag. Also, to facilitate removal of an ingot from a mold, the inside surface of the mold is sprayed with a parting compound.

2. Description of the Prior Art

Apparatus for removing slag from the inside of ingot molds is known and is exemplified by the equipment disclosed in U.S. Pat. Nos. 4,095,306 and 3,996,637. However, generally the inside of ingot molds is cleaned manually which is both time consuming and expensive. Manual cleaning of ingot molds is also dangerous since a worker must climb inside of the molds and chip the slag from the surface with a pneumatic tool which creates considerable dust. The present invention eliminates manual mold cleaning and results in a considerable saving in both time and money as well as safer working conditions.

SUMMARY OF THE INVENTION

The present invention is directed to apparatus for supporting tools for cleaning and spraying the inside of ingot molds by removing slag and other adherent material so that good quality ingots are produced which may be easily removed from the mold. The invention comprises a movable frame which supports an adjustable ram mounted on a movable carriage. The ram is articulated so that tools at its working end can be positioned to break slag and other adherent material from all locations on the inside of a mold and to spray the complete inside surface of a mold.

The apparatus includes a lift for the operator so that he is located at the proper height relative to the top of the mold being cleaned or sprayed for observation of the tools at the working end of the ram to ensure that the complete inside surface of the mold is contacted. The operator is removed from the dust created during cleaning, but he has an unobscured view of the tools at the end of the ram even when the tools are close to the bottom of the mold.

The invention will be best understood from a consideration of the accompanying drawings wherein like numerals identify like parts in each of the drawing figures.

DESCRIPTION OF THE PREFERRED EMBODIMENT

Figure 1:
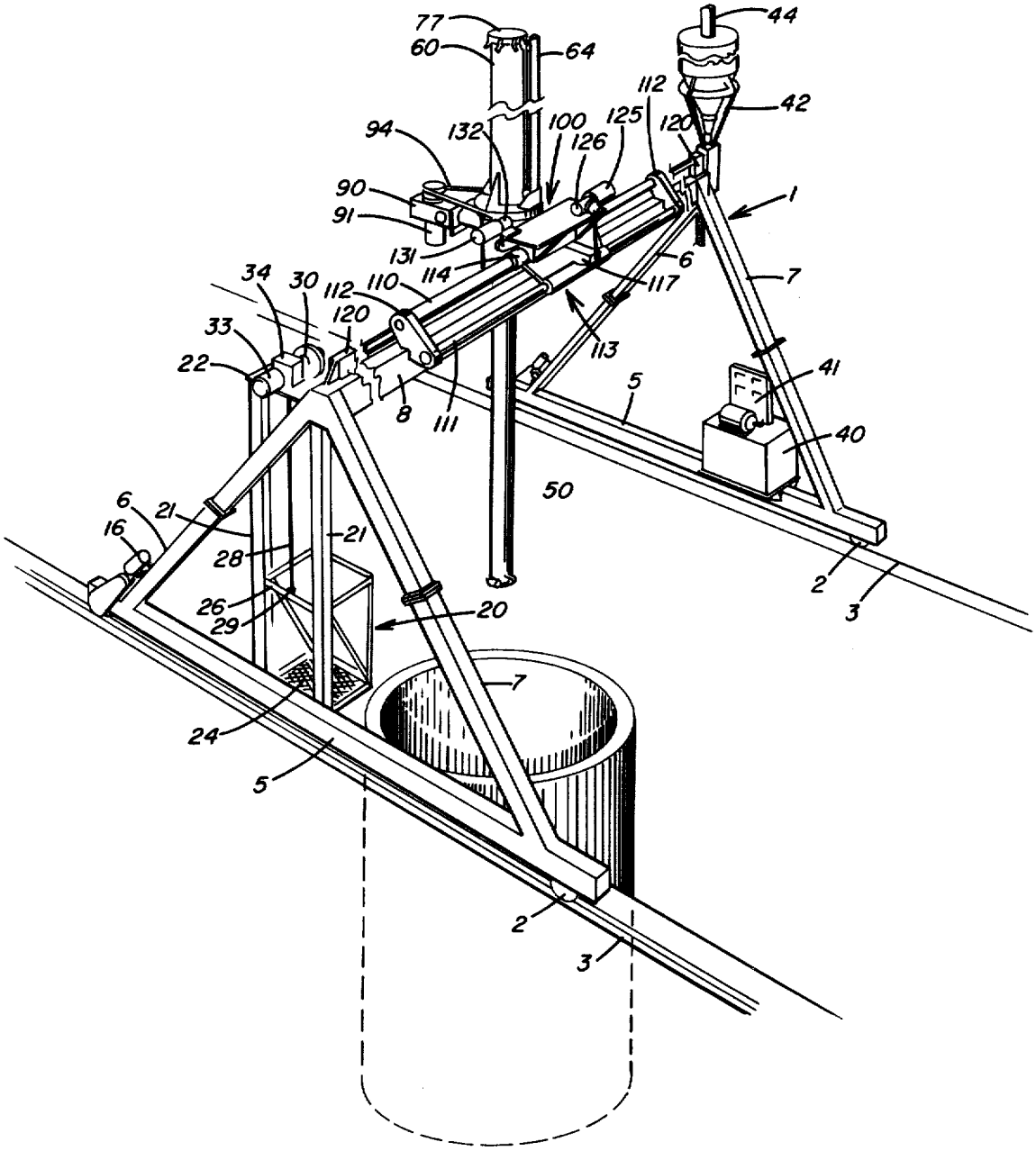
FIG. 1 is a perspective view of the mold cleaning apparatus located over a mold.

The support apparatus shown in FIG. 1 is carried on a frame 1 having flanged wheels 2 which move along parallel rails 3 located on opposite sides of a mold pit 4. An ingot mold to be treated is positioned with its open top generally below the support apparatus of the invention. Frame 1 has a pair of parallel horizontal members 5 located over rails 3 and carrying wheels 2 with front legs 6 and rear legs 7 extending angularly upwardly from the ends thereof. The upper ends of legs 6 and legs 7 intersect and support a generally horizontal cross member 8. All of the frame members are welded together. Each flanged wheel 2 is carried on an axle 9 supported in a pair of pillow blocks 10 which are suspended from a truck plate 11 attached to the underside of a frame member 5 adjacent to the ends of the frame member. The axle for each wheel located at the juncture of a horizontal frame member 5 and a front leg 6 carries a drive sprocket 12 on its outer end. Each drive sprocket 12 is connected by a chain 13 to a driven sprocket 14 carried on the drive shaft of a gear reducer 15 attached to an electric motor 16. A chain guard covers each pair of sprockets and the connecting chain. Operation of motors 16 drives front wheels 2 through the sprockets and the drive chains to move frame 1 along rails 3 on wheels 2.

A lift 20 is located at one side of frame 1 and is supported on the frame by a pair of spaced, vertical, parallel square tubes 21. The lower end of each tube 21 is welded to a horizontal frame member 5 and the upper end of each tube is welded to the lower surface of a support plate 22 which is welded to the frame. Each tube 21 carries a track member which extends from the bottom of the tube adjacent horizontal frame member 5 to the top of the tube adjacent support plate 22. Lift 20 carries rollers 23 which ride in the track members on square tubes 21 and permit vertical movement of the lift relative to frame 1. The lift has a floor 24 and handrails 26 which provide a compartment for the operator of the apparatus. A control panel 27 is located on the lift so that the support apparatus can be controlled by the operator from within the lift compartment.

Lift 20 is raised and lowered by a cable 28 which is fixed at its lower end to an eye bolt 29 carried on the lift. The upper end of cable 28 is attached to a cable drum 30 which is mounted on the upper surface of support plate 22. The cable drum is supported on a shaft 31 mounted in pillow blocks 32 supported on the upper surface of support plate 22. Shaft 31 is driven by a reversible electric motor 33 through a gear reducer 34 to rotate cable drum 30 to take up or let out the cable and move lift 20. The operator on the lift controls the movement of the lift relative to the top of a mold being cleaned or sprayed so that he has an unobstructed view of the portion of the inside surface of the mold being treated while being removed from the dust and dirt created as cleaning progresses or from material being sprayed on the inside surface of the mold. This position of the operator provides a safe and relatively pollution free environment.

A hydraulic power system 40 with controls 41 is mounted on the side of frame 1 opposite lift 20. The hydraulic power system and its controls are mounted on a horizontal frame member 5 so that the system and the controls therefor move with frame 1. Controls 41 are operated by electric selector switches on control panel 27 on lift 20. The hydraulic power system and controls therefor do not form a part of the instant invention, and, as will be understood by those skilled in the art, numerous hydraulic power systems and controls may be used to operate the equipment.

Frame 1 also supports dust collecting equipment D which is mounted on cross member 8 at the side of the frame above hydraulic power system 40. The dust collecting apparatus includes a collector drum supported on a mounting flange carried by a plurality of legs 42. The legs are supported on cross member 8 by a bracket 43. One end of a flexible hose 44 is attached to the top of the collector drum, and its other end is connected to a vacuum hose extending from a pipe in the ram tube. A discharge hose 45 is connected to the bottom of a cone-shaped member 46 which is connected to a slide valve 47 at the bottom of the collector drum and which is opened to empty the collector drum. The specific details of the dust collecting equipment and the slide valve are well known to those skilled in the art and are not a part of the instant invention. A container for a parting compound to be sprayed on the inside surface of a cleaned mold may also be mounted on cross member 8 of frame 1.

Figure 7:
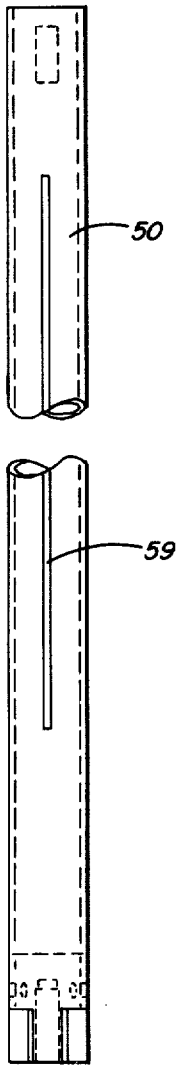
FIG. 7 is a front elevation of the ram tube.
Figure 8:
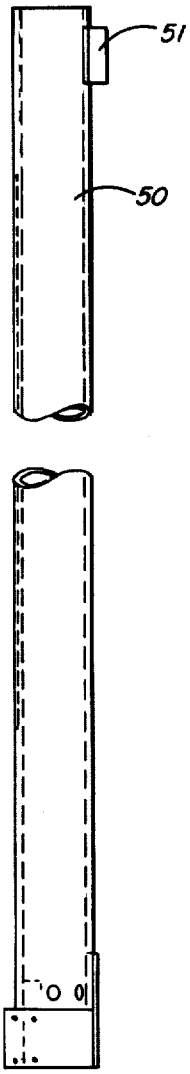
FIG. 8 is a side elevation of the ram tube.
Figure 9:
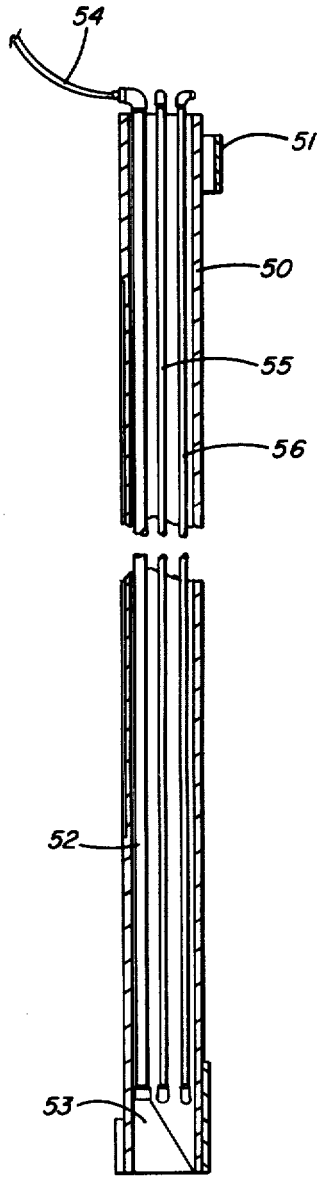
FIG. 9 is a vertical section through the ram tube.

Cross member 8 also supports a cylindrical ram tube 50 shown in detail in FIGS. 7–9, which carries tools at its lower end and supports pipes for supplying compressed air to the tools. Ram tube 50 also carries a suction head at its lower end and supports a vacuum pipe for cleaning debris from within the mold after it is removed from the inside of the mold. A pipe for supplying a parting compound to a spray tool at the lower end of ram tube 50 may also be supported in the ram tube along with the other pipes. An outwardly extending bracket 51 is fixed at the upper end of the ram tube and is attached to the cable of a hydraulic Tol-o-matic cable cylinder for raising and lowering the ram tube. A vacuum pipe 52 extends from the upper end of ram tube 50 to the lower end thereof where it is connected to a suction head 53. The upper end of pipe 52 is connected to an elbow which is connected to vacuum hose 54 which is connected to hose 44 from dust collector. In addition to vacuum pipe 52, ram tube 50 contains compressed air pipes 55 and 56 which extend downwardly from the upper end of the ram tube to the lower end thereof. Two air pipes 55 are angularly spaced 180° from each other and 90° on opposite sides of vacuum pipe 52. Two air pipes 56 are angularly spaced 45° from pipes 55 on the side of pipes 55 away from vacuum pipe 52. An elbow is connected to both ends of each pipe 55 and 56, and the lower elbows extend outwardly through holes in ram tube 50. The lower elbows on pipes 55 and 56 conduct compressed air to air motors and to air hammers mounted at the lower end of ram tube 50. Each air motor drives a grinding wheel and the grinding wheels and air hammers attack material accumulated on the inside of a mold. Ram tube 50 may also support electric cables (not shown) connected to electric grinders mounted at the lower end of the ram tube. The selection of grinding wheels, air hammers and electric grinders and their location at the lower end of ram tube 50 will be determined by the type of slag which must be removed. The air motors, grinding wheels, air hammers, electric grinders and spraying tools are all standard equipment and their specific construction does not form a part of the invention.

An elongated longitudinal key 59 is formed on the outside of ram tube 50. Key 59 cooperates with a keyway on the inner surface of a ram hub. The key and keyway maintain ram tube 50 and the ram hub in the same angular position when ram tube 50 and the ram hub are rotated. The outside diameter of the ram hub is fitted with a bronze bearing which fits in a cylinder to permit free rotation of the tube and the hub through 360° within the cylinder.

Figure 4:
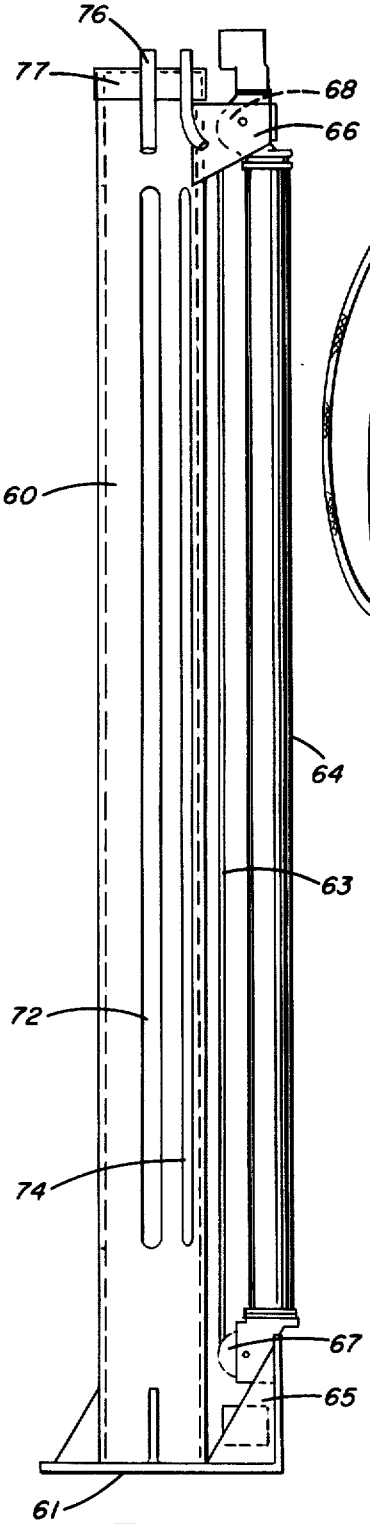
FIG. 4 is a side elevation of the ram tube housing and lift cylinder.
Figure 5:
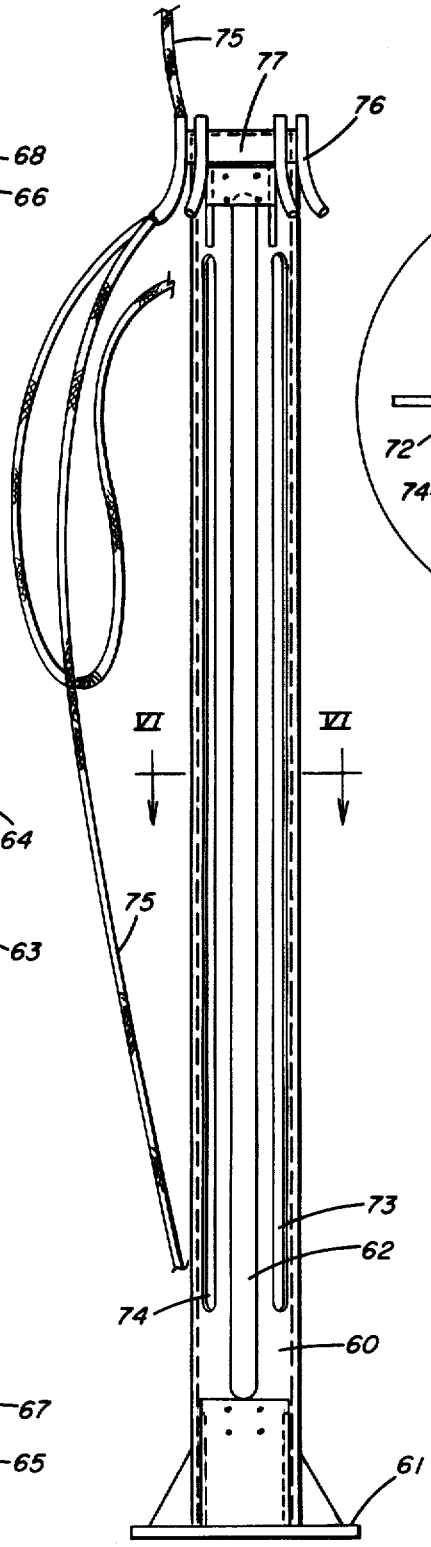
FIG. 5 is a rear elevation of the ram tube housing.
Figure 6:
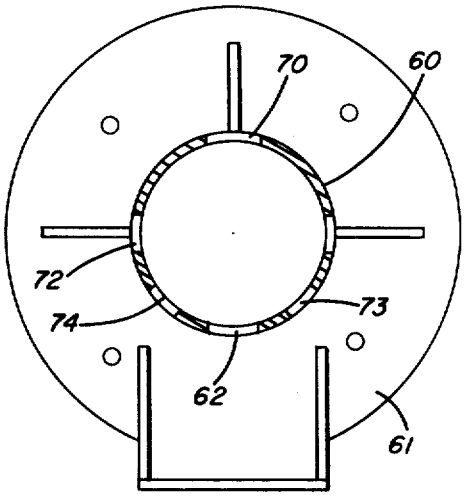
FIG. 6 is a section on line VI—VI of FIG. 5.

A housing 60 functions as a support column and is shown in detail in FIGS. 4–6 of the drawings. An annular plate 61 is welded to the lower end of housing 60 to mount the housing on an annular plate fixed to the upper end of the ram hub so that the housing rotates with the ram hub. The housing is provided with a longitudinal slot 62 which extends from the bottom to the top of the housing. Bracket 51 on ram tube 50 extends outwardly through the slot and is attached to cable 63 of a hydraulic Tol-o-matic cable cylinder 64 mounted on a lower bracket 65 attached to annular plate 61 at the lower end of housing 60 and to an upper bracket 66 which is vertically aligned with bracket 65 and is attached to the outside of housing 60 at the upper end. The cable is directed around a lower cable guide wheel 67 on bracket 65 and an upper cable wheel 68 on bracket 66. The cable enters cylinder 64 at both ends through seals and is attached to a piston within the cylinder. The piston is driven up and down along cylinder 64 by pressurized hydraulic fluid to move cable 63 and raise and lower ram tube 50 by bracket 51. Movement of bracket 51 upwardly by cable 63 raises ram tube 50, and movement of bracket 51 downwardly by the cable lowers ram tube 50.

In addition to longitudinal slot 62, housing 60 is provided with a longitudinal vacuum hose slot 70 spaced 180° from slot 62. Vacuum hose slot 70 accommodates vacuum hose 54 which extends from an elbow at the top of vacuum pipe 52 in the ram tube. Four longitudinal air hose slots 71, 72, 73 and 74 are also formed in housing 60. Air hose slots 71 and 72 are angularly spaced 180° from each other, and each of these slots is spaced 90° from slots 62 and 70. Air hose slots 73 and 74 are angularly spaced 45° from air hose slots 71 and 72 and from slot 62. Each air hose slot accommodates an air supply hose 75, only one of which is shown in FIG. 5 of the drawings. However, it will be understood that there is an air hose in each of air hose slots 71, 72, 73 and 74 for connection with the upper elbow on an air pipe 55 or 56 for supplying compressed air to air motors and to operate air hammers at the bottom of the ram tube. As will be seen in FIG. 5 of the drawings, each air hose extends downwardly to the bottom of its hose slot in tube housing 60 when ram tube 50 is in the lower position and is in a loop when ram tube 50 is in the upper position. Each air hose and the vacuum hose extend through a curved guide pipe 76 welded to cap 77 at the upper end of housing 60. The ends of curved pipes 76 are rounded so that the hoses are not cut or abraded when they are bent by vertical movement of the ram tube.

Figure 2:
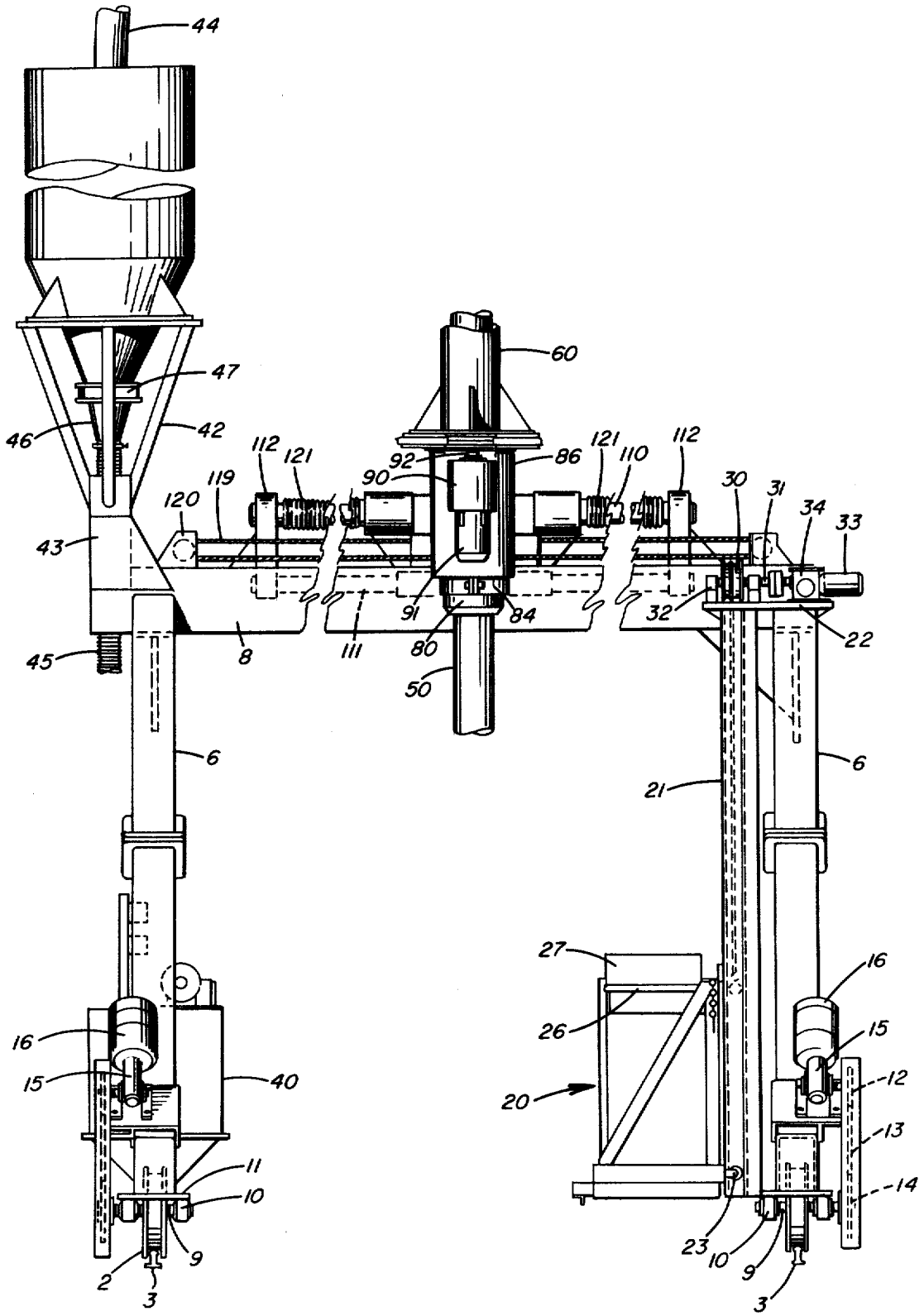
FIG. 2 is a front elevation of the apparatus with parts broken away.
Figure 3:
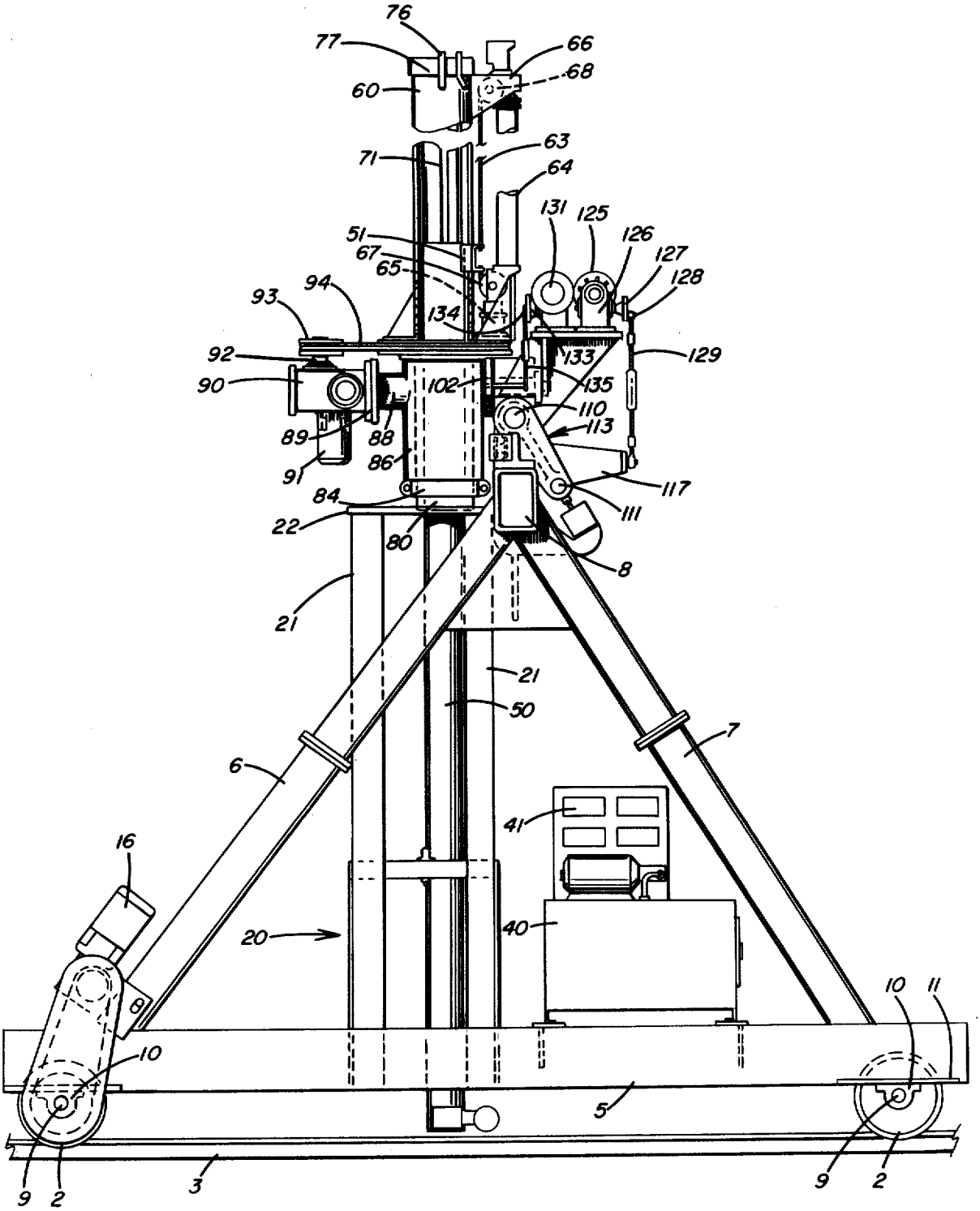
FIG. 3 is a side elevation of the apparatus with parts broken away.
Figure 10:
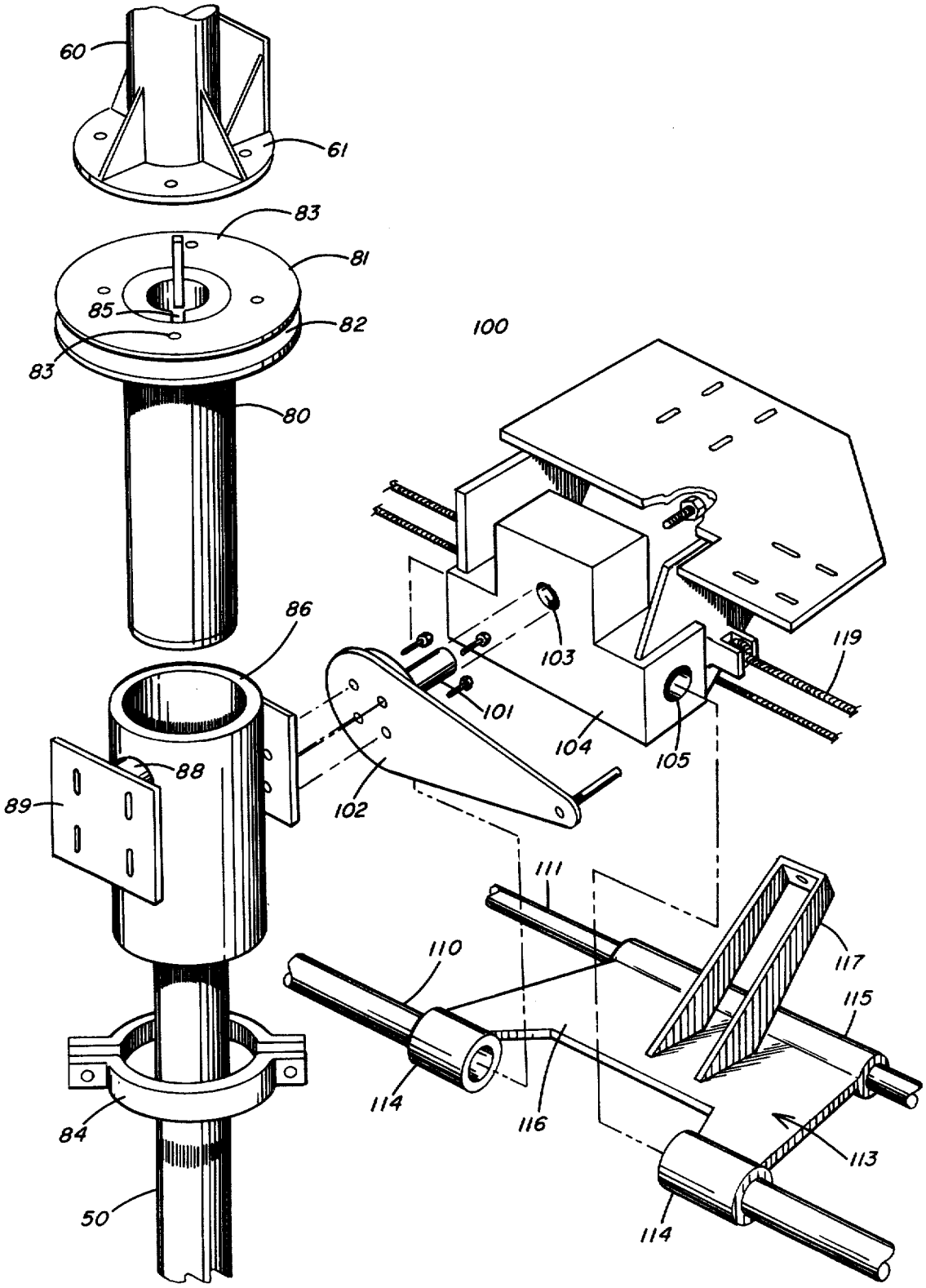
FIG. 10 is an exploded perspective view of the ram tube mounting arrangement with parts broken away.

The ram tube extends downwardly from housing 60 through a ram hub 80 carried in a cylinder 86 as shown in FIGS. 2, 3 and 10 of the drawings. An annular plate 81 is welded at the top of ram hub 80 and its periphery is formed with a groove 82 to receive a drive belt to rotate the ram hub. The annular plate has holes 83 to receive bolts to attach annular plate 61 on the lower end of housing 60. The ram hub extends below the lower end of the cylinder and is held in the vertical position relative to the cylinder by a split clamp 84. The clamp permits rotary movement of the ram hub relative to cylinder 86. The inside of ram hub 80 is formed with a keyway 85 to receive longitudinal key 59 on the outer surface of ram tube 50. Cylinder 86 is fitted on an internal bronze bearing (not shown) which receives ram hub 80 and permits rotation thereof. The cylinder has an arm 88 extending outwardly therefrom with a plate 89 welded to its end. A gear reducer 90 supporting a reversible electric motor 91 is bolted to plate 89. A drive shaft 92 extends upwardly from gear reducer 90 and carries a drive drum 93. A drive belt 94 extends from drive drum 93 around groove 82 in annular plate 81 so that when electric motor 91 transmits power through gear reducer 90 to shaft 92 to rotate drive drum 93, drive belt 94 rotates plate 81 which rotates ram hub 80, ram tube 50 and housing 60 relative to cylinder 86 and frame 1. Thus, movement of drive belt 94 rotates ram tube 50 to position the various tools located at the lower end of the ram tube in order to present appropriate tools to the area of the inside of the mold which is being cleaned or sprayed.

In addition to being rotatable about its axis through 360°, ram tube 50 is articulated relative to frame 1 to present the tools to different areas of the mold which are to be cleaned or sprayed. This articulation is accomplished by the mounting arrangement which supports cylinder 86 on frame 1. As will be seen in FIGS. 1–3 and 10 of the drawings, cylinder 86 is attached to an oscillator bracket 100 by a pin 101 with a securing bolt (not shown) at its end. Pin 101 extends outwardly from a generally triangular shaped arm 102 bolted to a bracket welded to cylinder 86 at the side diametrically opposite arm 88. Pin 101 extends through a hole 103 in a T-shaped guide block 104 which supports oscillator bracket 100. Guide block 104 also has an elongated cylindrical passage 105 therethrough which is mounted on an elongated shaft 110. Shaft 110 and a parallel shaft 111 are supported in brackets 112 mounted on cross member 8 of frame 1. An oscillator slide carriage 113 is mounted on shafts 110 and 111. Carriage 113 has sockets 114 which are provided with bearings which embrace shaft 110 and with a socket 115 which has bearings embracing shaft 111 for movement of the carriage along the shafts. The sockets are connected by a web 116 which has an angularly upstanding bracket 117 welded thereto.

The cylinder 86 and the elements attached thereto may be moved along shafts 110 and 111 in a direction parallel to cross member 8 by a Tol-o-matic cylinder having a cable 119 which is carried by brackets 120 welded to cross member 8 to move the ram tube 50 along cross member 8 of frame 1. Each portion of shaft 110 located between oscillator slide carriage 113 and a bracket 112 is surrounded by a bellows 121 to protect the shaft. The Tol-o-matic cylinder operating cable 119 functions in the same manner as Tol-o-matic cylinder 64 for raising and lowering ram tube 50 in housing 60. Thus, application of hydraulic fluid to one side of the piston within the cylinder will move the piston and cable 119 attached thereto to pull oscillator slide carriage 113 and attached bracket 100 and cylinder 86 along shafts 110 and 111.

Oscillator bracket 100 carries a reversible electric motor 125 which drives a reduction gear 126 having an output shaft carrying a crank 127 carrying a crank pin 128. Crank pin 128 is connected to the upper end of an adjustable turnbuckle type linkage 129. The lower end of adjustable linkage 129 is connected to the end of bracket 117 on oscillator slide carriage 113. When the ram tube 50 is in its vertical position, linkage 129 is adjusted with crank pin 128 in the horizontal position so that rotation of the crank by motor 125 through reduction gear 126 will pivot the ram tube about elongated shaft 110 so that the lower end of the ram tube moves in an arcuate direction parallel to rails 3.

A second electric motor 131 is carried on bracket 100 and it drives a reduction gear 132 which has a crank 133 on its shaft. Crank 133 has a crank pin 134 which is attached to the upper end of an adjustable turnbuckle type linkage 135. The lower end of linkage 135 is connected to the outer end of arm 102 which is bolted to a bracket on cylinder 86. The operation of motor 131 to rotate crank 133 through reduction gear 132 and raise or lower crank pin 134 and linkage 135 pivots oscillator bracket 100 about pin 101 to move the lower end of ram tube 50 in an arcuate direction perpendicular to rails 3.

It will be realized by those skilled in the art that while crank pins 128 and 134 move only a short distance, the arcuate distance traveled by the lower end of ram tube 50 is greatly magnified because of the distance between the pivot point of the ram tube and the lower end of the ram tube.

The hydraulic and the compressed air supply actuators for moving the ram tube are operated by standard electric solenoid valves which are well known to those skilled in the art and which form no part of the invention. The electric solenoid valves are controlled by standard selector switches on control panel 27, and the modes of operation include control of feed rates for quick acceleration of the various ram movements. The air supply to the air motors and the air hammers is also controlled by solenoid valves which have electric switches operated from control panel 27 on lift 20. The control panel also has electric switches for controlling the various electric motors on the tool support apparatus and the electric tools supported thereon.

As is apparent, the tool support apparatus of the invention makes it possible to rapidly clean or spray the entire inside surface of a mold while the operator is located in a position where he can observe the cleaning and spraying actions of the tools at the lower end of the ram tube and remain away from the polluted air created by cleaning and spraying. Additionally, the apparatus is safe to operate because of the operator's location away from the contact area between the tools and the inside of the mold. The apparatus is fully automated and is completely controlled by controls on the control panel located in the operator lift. The apparatus is efficient and molds may be cleaned and sprayed much more inexpensively than with known automated apparatus or manually.

While preferred embodiments of the invention are described herein, it is to be understood that it may be embodied within the scope of the appended claims.

I claim:

1. Tool support apparatus comprising a frame, a vertical ram tube adapted to carry tools at its lower end, means supporting said ram tube on said frame, said means supporting said ram tube on said frame including a first means for moving said ram tube in a first linear direction, a second means for moving the lower end of said ram tube in a first arcuate direction, a third means for moving the lower end of said ram tube in a second arcuate direction, a fourth means for vertically moving said ram tube, whereby the lower end of said ram tube may be moved linearly, arcuately and vertically to position the lower end of said ram tube.

2. Apparatus as set forth in claim 1 including wheels on said frame adapted to move said frame and means to drive said wheels, whereby said frame and said ram tube are moved in a second linear direction perpendicular to said first linear direction.

3. Apparatus as set forth in claim 2 wherein said means to drive said wheels are electric motors mounted on said frame.

4. Apparatus as set forth in claim 1 wherein said first means for moving the lower end of said ram tube in said first linear direction consists of a hydraulic cylinder on said frame and means connecting said hydraulic cylinder to said means mounting said ram tube on said frame.

5. Apparatus as set forth in claim 1 wherein said second means for moving the lower end of said ram tube in said first arcuate direction is an electric motor.

6. Apparatus as set forth in claim 1 wherein said third means for moving the lower end of said ram tube in said second arcuate direction is an electric motor.

7. Apparatus as set forth in claim 1 wherein said means supporting said ram tube on said frame includes a cylinder, a plurality of parallel shafts mounted on said frame, an oscillator bracket mounted on one of said parallel shafts for movement along said shaft, said cylinder mounted on said oscillator bracket, hydraulic means mounted on said frame and means attaching said hydraulic means to said oscillator bracket for moving said bracket and said cylinder along said shaft.

8. Apparatus as set forth in claim 1 wherein said means supporting said ram tube on said frame includes a cylinder mounted on said frame, a hub within and rotatable relative to said cylinder, said ram tube being mechanically connected to said hub and means on said cylinder to rotate said hub, whereby rotation of said hub rotates said ram tube relative to said cylinder and said frame.

9. Apparatus as set forth in claim 8 wherein said hub has an annular plate attached to its upper end, a groove in the outer periphery of said annular plate, said means on said cylinder to rotate said hub relative to said cylinder and said frame being a belt in said groove formed on said annular plate and a motor driven cable drive drum mounted on said cylinder and a motor to drive said drum.

10. Apparatus as set forth in claim 9 including a cylindrical housing mounted on the upper surface of said annular plate for rotation with said hub, said cylindrical housing surrounding the upper portion of said ram tube, a longitudinal slot in said housing, bracket means on said ram tube extending outwardly through said longitudinal slot in said housing and said fourth means for vertically moving said ram tube is hydraulic means mounted on said housing and attached to said bracket to raise and lower said ram tube relative to said housing and to said hub.

11. Apparatus as set forth in claim 1 or 10 wherein said ram tube includes a plurality of pipes extending between the top and the bottom thereof, the top end of each of said pipes being attached to a flexible hose and the bottom end of each of said pipes adapted to be attached to a tool, whereby compressed air is supplied through flexible hoses and through said pipes to operate the tools.

12. Apparatus as set forth in claim 11 wherein said ram tube includes a suction head at the lower end, a suction pipe extending from said suction head to the top of said ram tube, a vacuum hose attached to the upper end of said suction pipe and adapted to extend to a dust collector, whereby dust and particulate matter created by the cleaning of the inside of an ingot mold is removed from the bottom of said mold by said suction head and said suction pipe.

13. Apparatus as set forth in claim 1 including a vertically movable operator station mounted on said frame, means for moving said operator station and controls on said operator station for controlling the movement of said ram tube.

* * * * *